US005767871A

United States Patent [19]

Imai

[11] Patent Number: 5,767,871

[45] Date of Patent: Jun. 16, 1998

[54] INK JETTING DEVICE WITH TIME LAG INK JETTING

[75] Inventor: Koji Imai, Nagoya, Japan

[73] Assignee: Brother Kogyo Kabushiki Kaisha, Nagoya, Japan

[21] Appl. No.: 391,174

[22] Filed: Feb. 21, 1995

[30] Foreign Application Priority Data

May 13, 1994 [JP] Japan ..... 6-099917

[51] Int. Cl.[6] ..... B41J 29/38

[52] U.S. Cl. ..... 347/10; 347/12

[58] Field of Search ..... 347/10, 11, 12, 347/9, 13, 68, 69, 40

[56] References Cited

U.S. PATENT DOCUMENTS

| | | | |
|---|---|---|---|
| 3,946,398 | 3/1976 | Kyser et al. . | |
| 4,300,144 | 11/1981 | Isayama et al. | 347/12 |
| 4,723,129 | 2/1988 | Endo et al. . | |
| 4,750,010 | 6/1988 | Ayers et al. | 358/298 |
| 4,879,568 | 11/1989 | Bartky et al. . | |
| 4,887,100 | 12/1989 | Michaelis et al. . | |
| 5,266,965 | 11/1993 | Komai et al. . | |
| 5,432,540 | 7/1995 | Hiraishi | 347/69 |

FOREIGN PATENT DOCUMENTS

| | | |
|---|---|---|
| A-53-12138 | 2/1978 | Japan . |
| A-61-59914 | 3/1986 | Japan . |
| A-63-252750 | 10/1988 | Japan . |
| 4-235044 | 8/1992 | Japan . |

*Primary Examiner*—David F. Yockey
*Attorney, Agent, or Firm*—Oliff & Berridge

[57] ABSTRACT

An ink jetting device having plural ink channels whose volume is variable in accordance with deformation of piezoelectric elements, and a controller that applies a voltage to the piezoelectric elements and includes at least two timing generating circuits that oscillate timing signals for ink jetting with a time lag for a period that is shorter than the period from the time when the voltage is applied to the piezoelectric elements until the time when the voltage application is stopped, and a driving circuit that is provided in correspondence with each ink channel and serves to latch a signal representing whether ink jetting is performed and apply the voltage to the piezoelectric elements on the basis of the latched signal when receiving the signals from the timing generating circuits.

23 Claims, 14 Drawing Sheets

INK JETTING DEVICE WITH TIME LAG INK JETTING

BACKGROUND OF THE INVENTION

1. Field of the Invention

The present invention relates to an ink jetting device for jetting ink by use of deformation of a piezoelectric element.

2. Description of Related Art

Non-impact type printing devices are now superseding impact type printing devices that have been hitherto utilized, and have increasingly propagated in the market. Of these non-impact type printing devices, an ink jetting type printing device is more popular because it has the simplest printing principle and it facilitates a color printing operation with high gradation. In this type of printing device, a drop-on-demand type printing device, in which only an ink droplet for printing is jetted, has been rapidly propagating in the market because of its high ink jetting efficiency and low running cost.

The drop-on-demand type printing devices have been representatively known as a Kyser type, as disclosed in, for example, Japanese Patent Publication No. 53-12138 and as a thermal jet type, as disclosed in, for example Japanese Patent Publication No. 61-59914. However, these types of printing devices have a number of critical problems. With respect to the Kyser type, it is difficult to design the device in a compact size. With respect to the thermal jet type, ink is heated at high temperature, and the ink is therefore required to have high heat-proof property.

In order to solve both of the above problems, a shear mode type as disclosed in Japanese Laid-open Patent Publication No. 63-252750 is proposed as a new type of printing device.

FIG. 9 shows a shear mode type of ink jetting device. As shown in FIG. 9, the shear mode type of ink jetting device 1 comprises a piezoelectric ceramic plate 2, a cover plate 10, a nozzle plate 14 and a base plate 41.

The piezoelectric ceramic plate 2 is cut with a diamond blade or the like to form plural grooves 3 on the plate 2. These grooves 3 have the same depth and are designed in parallel to one another, and side walls 6 corresponding to the side surfaces of the grooves 3 are polarized in a direction as indicated by an arrow 5. The grooves 3 are designed to be gradually shallower as they approach one end surface 15 of the piezoelectric ceramic plate 2, thereby forming shallow grooves 7 in the neighborhood of the one end surface 15. Metal electrodes 8 are formed at upper half portions on both inner side surfaces of the grooves 3 by a sputtering method or the like, and metal electrodes 9 are formed on the side and bottom surfaces of the shallow groove 7 inner surfaces. With this construction, the metal electrodes 8 formed at both side surfaces of the grooves 3 are electrically connected to one another through the metal electrodes 9 formed in the shallow grooves 7.

The cover plate 10 is formed of a ceramic material, a resin material or the like, and an ink supply port 16 and a manifold 18 are formed in the cover plate 10 by a grinding or cutting process. One surface of the piezoelectric ceramic plate 2 on which the grooves 3 are formed (hereinafter referred to as a "groove-formed surface") is adhesively attached to one surface of the cover plate 10 on which the manifold 18 is formed (hereinafter referred to as a "manifold-formed surface") with an epoxy-based adhesive 20 (see FIG. 11). Accordingly, the grooves 3 are hermetically covered with the cover plate 10 on the upper surfaces thereof, and with this arrangement, the ink jetting device 1 is provided with plural ink channels 4 that correspond to ink passageways and are arranged laterally at a fixed interval (see FIG. 11). As shown in FIG. 11, each ink channel 4 is designed in a slender shape having a rectangular section, and ink is filled in all the ink channels.

A nozzle plate 14, which is provided with nozzles 12 so as to confront the respective ink channels 4, is adhesively attached to one of the piezoelectric ceramic plate 2 side surfaces and the cover plate 10. The nozzle plate 14 is formed of a plastic material such as polyalkylene (for example, ethylene), terephthalate, polyimide, polyether imide, polyether ketone, polyether sulfone, polycarbonate, cellulose acetate or the like.

The base plate 41 is adhesively attached to the other end surface of the piezoelectric ceramic plate 2, which is opposite to the groove-formed surface thereof, with an epoxy-based adhesive or the like. A conductive layer pattern 42 is formed on the base plate 41 so as to confront each of the ink channels 4. The conductive layer patterns 42 and the metal electrodes 9 on the bottom surfaces of the shallow grooves 7 are connected to one another through conductive wires 43 by a wire bonding method.

Next, the construction of a controller will be described with reference to the block diagram of FIG. 10. Each of the conductive layer patterns 42 formed on the base plate 41 is individually connected to an LSI chip 51. Further, a clock line 52, a data line 53, a voltage line 54 and a ground line 55 are connected to the LSI chip 51. On the basis of a train of clock pulses supplied from the clock line 52, the LSI chip 51 identifies nozzles through which an ink droplet should be jetted in accordance with data appearing on the data line 53, and then applies a voltage V of the voltage line 54 to the conductive layer patterns 42 that are connected to the metal electrodes 8 of the ink channels 4 to be driven (corresponding to the identified nozzles). In addition, the LSI chip 51 applies a zero voltage of the ground line 55 to the conductive layer patterns 42 that are connected to the metal electrodes 8 of the ink channels other than the ink channels 4 to be driven.

FIGS. 15A and 15B are equivalent circuit diagrams showing a connection arrangement of the ink jetting device and the LSI chip 51. Each driver 61 of the LSI chip 51 is connected to a capacitor 62, which is constructed by a side wall 6, and metal electrodes 8, which are provided on both side surfaces of the side wall 6. Since the metal electrodes that are facing each other through each groove 3 are connected to each other in each shallow groove 7, the respective capacitors 62 are connected to one another in series.

Next, the operation of the ink jetting device 1 will be described with reference to FIGS. 11 and 12. It is assumed that the LSI chip 51 determines an ink jetting operation from an ink channel 4B in accordance with desired data. With this judgment, the LSI chip 51 applies a positive driving voltage V to metal electrodes 8E and 8F and connects metal electrodes 8D and 8G to the ground. In this case, a driving electric field in a direction indicated by an arrow 13B occurs in the side wall 6B, and a driving electric field in a direction indicated by an arrow 13C occurs in the side wall 6C. At this time, the electric-field directions 13B and 13C are perpendicular to the polarization direction 5 of the side walls so that the side walls 6B and 6C are rapidly deformed inwardly into the ink channel 4B by a thickness shear effect. Through this deformation, the volume of the ink channel 4B decreases, and the ink pressure in the ink channel 4B rapidly increases so that a pressure wave occurs, and an ink droplet is jetted from the nozzle 12 intercommunicating with the ink channel 4B.

When the application of the driving voltage V is stopped, the side walls 6B and 6C are returned to their initial positions before the deformation (see FIG. 11), and the ink pressure in the ink channel 4B is gradually reduced so that the ink is supplied from an ink tank (not shown) through the ink supply port 16 (FIG. 9) and the manifold 18 (FIG. 9) into the ink channel 4B.

If the side walls are polarized in the direction opposite to the polarization direction as described above, it will be understood that the side walls 6B and 6C are first deformed to be separated from each other by applying the driving voltage, and following application of the driving voltage, the walls 6B and 6C are returned to their initial positions before the deformation by stopping the application of the voltage, thereby jetting the ink droplet.

However, in a case where image information is formed on a recording medium using the ink jetting device 1 thus constructed, it is structurally inhibited in that the ink droplet is prevented from being jetted from at least adjacent ink channels 4 at the same time. Therefore, as described in Japanese Laid-open Patent Publication No. 2-150355, the ink channels 4 may be classified into a group of odd-numbered ink channels 4 and a group of even-numbered ink channels 4, and the ink jetting operation is alternately performed by each of these groups. For example, it is assumed that ink channels 4A, 4C and 4E are grouped as an odd group, and ink channels 4B, 4D and 4F are grouped as an even group.

The driving waveform and the motion of the side walls when the ink channels are grouped into the odd and even groups and when the ink jetting operation is alternately performed by each group will be described with reference to FIGS. 13A to 13D, 14A to 14C, 15A and 15B.

FIGS. 13A to 13D show the driving voltage waveform of the driver 61 to be applied to the odd and even groups, and the current waveform to be supplied from the driver 61. FIGS. 14A to 14C show a motion of the side walls 6 of each ink channel 4. The side walls 6 are polarized in the direction as indicated by an arrow 71. Through the grouping, the ink channels 4A, 4C and 4E are grouped as an odd group, and the ink channels 4B and 4D are grouped as an even group.

In the driving voltage waveform of FIGS. 13A to 13D, for a time before t1, the voltage to be applied to all the ink channels is set to zero, and no deformation is made in the side walls as shown in FIG. 14A. Further, no current flows from the driver 61 as shown in FIG. 15A. At the instant when the time is equal to t1, the voltages to be applied to the ink channels 4A and 4C of the odd group rise up to Va and Vc as shown in FIGS. 13A and 13C respectively, and the deformation is made in each side wall 6 as shown in FIG. 14B.

At this time, as shown in FIG. 15B, a driver **61*a* from which a voltage is applied supplies current Ia1 to capacitors 62*a* and 62*b* half by half to charge the capacitors 62*a* and 62*b*. Likewise, a driver 61*c* from which a voltage is applied supplies current Ic1 to capacitors 62*c* and 62*d* half by half to charge the capacitors 62*c* and 62*d*. On the other hand, through the capacitors 62*b* and 62*c* a current of (½Ia1+½Ic1) flows into a driver 61*b*** from which no voltage is applied.

Through the deformation as described above, a negative pressure is induced in each ink channel of the odd group, and a positive pressure is induced in each ink channel of the even group. This deformation is continued during a period from the time t1 until the time t2, when the deformation is returned to zero as shown in FIG. 14C, and thus, a positive pressure is applied to each ink channel of the odd group. At this time, the capacitor 62 is rapidly discharged, so that sharp currents of −Ia2, ½Ia2+½Ic2 and −Ic2 flow into the drivers **61*a*, 61*b* and 61*c* respectively as shown in FIG. 13A 13C**.

The time interval between t1 and t2 is ordinarily set to L/a ("L" being the distance from the manifold 18 to the nozzle plate 14 within the ink channel 4, and "a" being sound velocity). The reason for this is as follows. According to the pressure wave propagation theory, the negative pressure wave that is induced in the odd group at t1 is inverted to the positive pressure wave at t2, and the deformation of the side walls is returned to zero in synchronism with this returning operation of the displacement so that higher pressure is obtained, and the ink droplet can be jetted from the ink channels of the odd group through the nozzle holes (see FIG. 9). No pulse is applied to even the ink channels of the odd group if no ink is required to be jetted from these ink channels. Further, the same ink jetting operation as the odd group is conducted on the ink channels of the even group with a pulse Vb or Vd.

When the ink channels are used while classified into plural groups as described above, the driving voltage waveform to be applied to the ink channels 4 must rapidly rise up and fall down, that is, it must have the sharp leading and trailing edges in order to produce sufficient pressure in the ink channels, and thus, the current flowing in each driver 61 has the sharp pulse shape at the times t1 and t2 in the case as described above. As a result, the current obtained by adding the current peaks of all the drivers instantaneously flows in the voltage line 54 and the ground line 55 of the LSI chip 51 constituting the driver. Due to such a circumstance, it is difficult to ensure a sufficient power source and a ground layer for formation of the LSI driver and to compensate for noises of a set containing the LSI driver, resulting in higher costs of the print device.

SUMMARY OF THE INVENTION

An object of the present invention is to provide an ink jetting device that is capable of performing a high-speed print operation using an inexpensive print device.

In order to attain the above object, an ink jetting device is provided having plural ink channels whose volumes are variable in accordance with deformation of piezoelectric elements, and a controller for applying a voltage to the piezoelectric elements. The controller includes at least two timing generating circuits that oscillate timing signals for ink jetting with a time lag for a period that is shorter than the period from the time when the voltage is applied to the piezoelectric elements until the time when the voltage application is stopped, and a driving circuit that is provided in correspondence with each ink channel and serves to latch a signal representing whether the ink jetting is performed and to apply the voltage to the piezoelectric elements on the basis of the latched signal when receiving the signals from the timing generating circuits.

At least parts of the plural ink channels are insulated from one another by partition walls formed of piezoelectric elements.

In the ink jetting device of the present invention, at least two timing generating circuits oscillate timing signals for ink jetting with a time lag for a period that is shorter than the period from the time when the voltage is applied to the piezoelectric elements until the time when the voltage application is stopped, and the driving circuit that is provided in correspondence with each ink channel latches a signal representing whether an ink droplet is jetted and applies the voltage to the piezoelectric elements on the basis of the latched signal when receiving the signals from the timing generating circuits, thereby jetting the ink droplet from the ink channels.

Accordingly, since a time lag is set between the timing of the voltage to be applied for ink jetting and the voltage stopping timing, the current pulse occurring in the controller is dispersed, and the peak value thereof can be reduced. Therefore, the manufacturing cost of the controller and the countermeasure cost for noises occurring in a set in which the controller is installed can be reduced, and the printing operation can be performed at a high speed.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

Figures 1A, 1B, 1C, 1D:
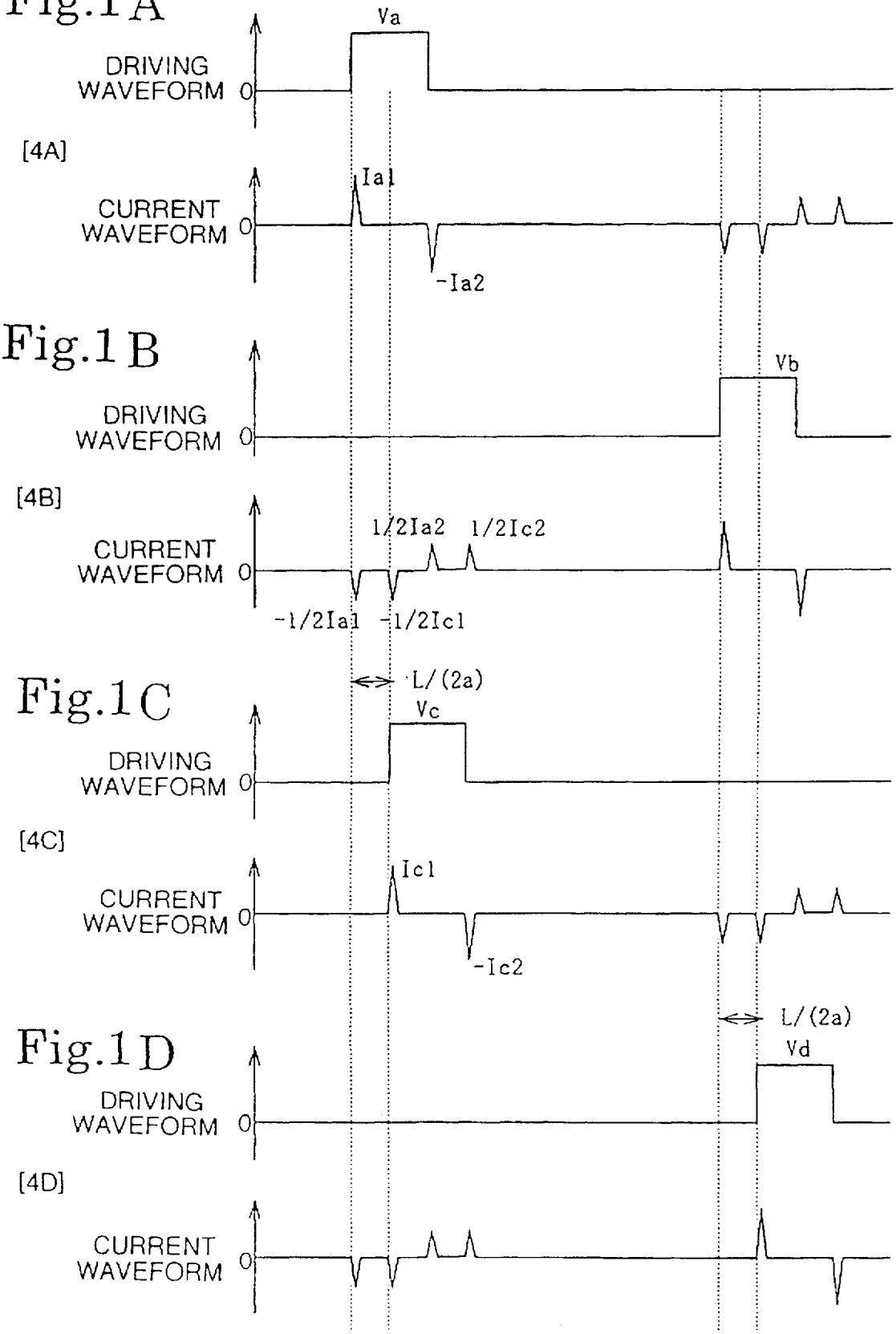
FIGS. 1A to 1D are timing charts showing a driving method of an embodiment of the present invention.

Preferred embodiments according to the present invention will be described hereunder with reference to the accompanying drawings. The same elements as the prior art as described above are represented by the same reference numerals, and the description thereof is omitted. The same ink jetting device is used in the following embodiments except that the polarization direction is opposite to that of the ink jetting device shown in FIGS. 9 to 12.

First, the operation of the ink jetting device using the driving method of this invention when the ink channels of the ink jetting device are grouped into two groups and alternately driven will be described with reference to FIGS. 1A to 1D, 2A to 2C, 3A, 3B and 4.

FIGS. 1A to 1D are timing charts for driving voltage pulse waveforms and current pulse waveforms. In FIGS. 1A to 1D, four driving voltage pulse waveforms are applied to the ink channels 4A, 4B, 4C and 4D of FIGS. 2A to 2C, respectively.

Figure 2A:
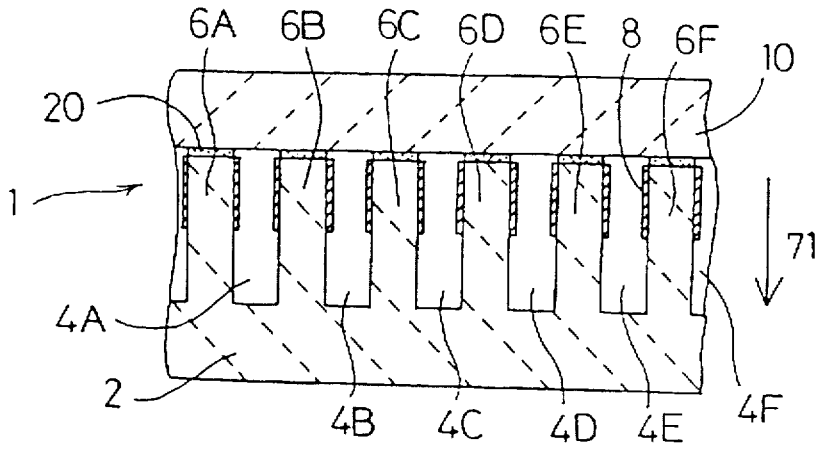
FIGS. 2A to 2C are cross-sectional views showing an ink jetting device of an embodiment of the present invention.
Figure 2B:
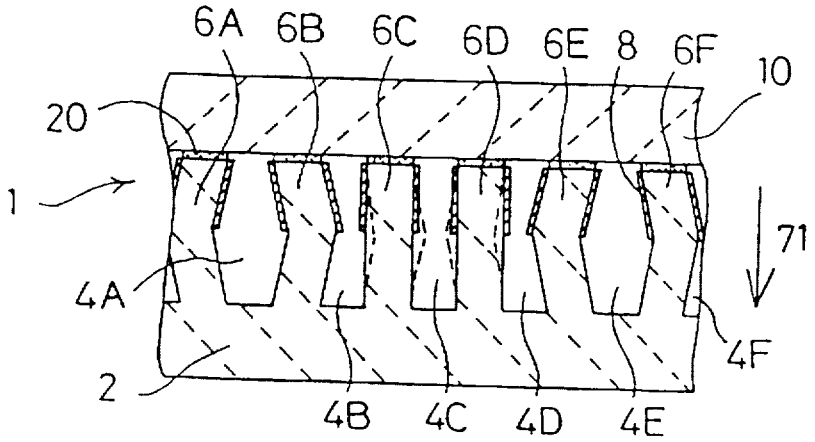
Figure 2C:
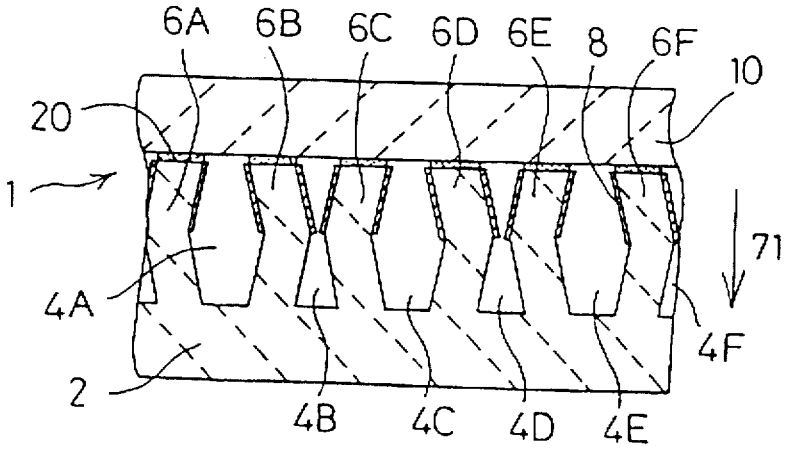

FIGS. 2A to 2C show the motion of the side walls 6 of the respective ink channels 4. The grouping is performed as follows: the ink channels 4A, 4C, . . . are grouped as an odd group and the ink channels 4B, 4D, . . . are grouped as an even group.

Figure 4:
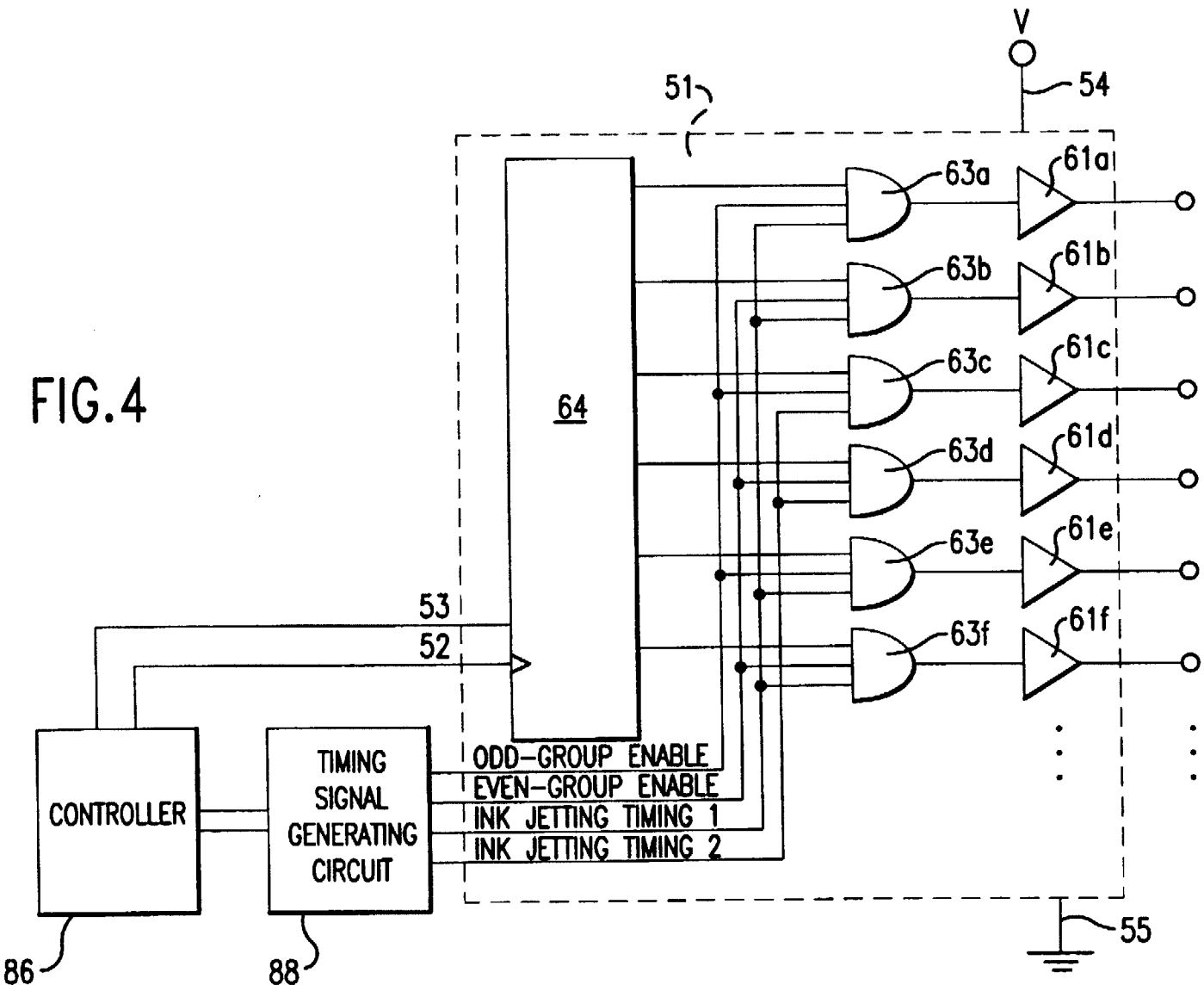
FIG. 4 is a diagram showing an internal construction of a controller of an embodiment of the present invention.

FIG. 4 shows the internal construction of the LSI chip 51 operably coupled to a controller 86 and a timing signal generating circuit 88. The controller 86 and the timing signal generating circuit 88 are also operably coupled. On the basis of a train of clock pulses, which are serially supplied from the clock line 52, the LSI chip 51 latches into a serial-parallel converter (hereinafter referred to as "SP converter") 64 data that are transmitted as serial data and appear on the data line 53, thereby converting the data to parallel data.

Figure 3A:
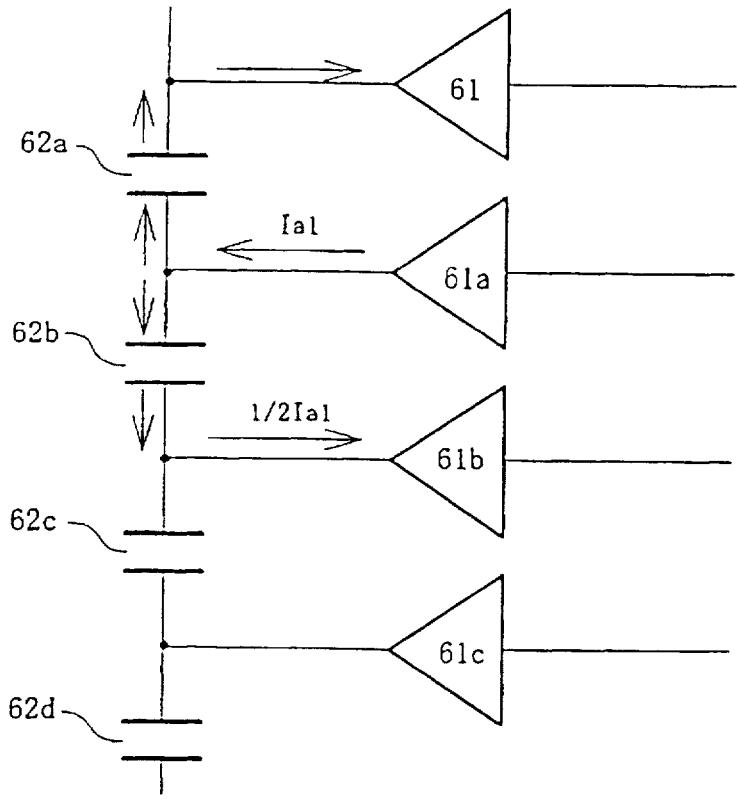
FIGS. 3A and 3B are equivalent circuit diagrams showing a connection arrangement of an ink jetting device and a controller of an embodiment of the present invention.
Figure 3B:
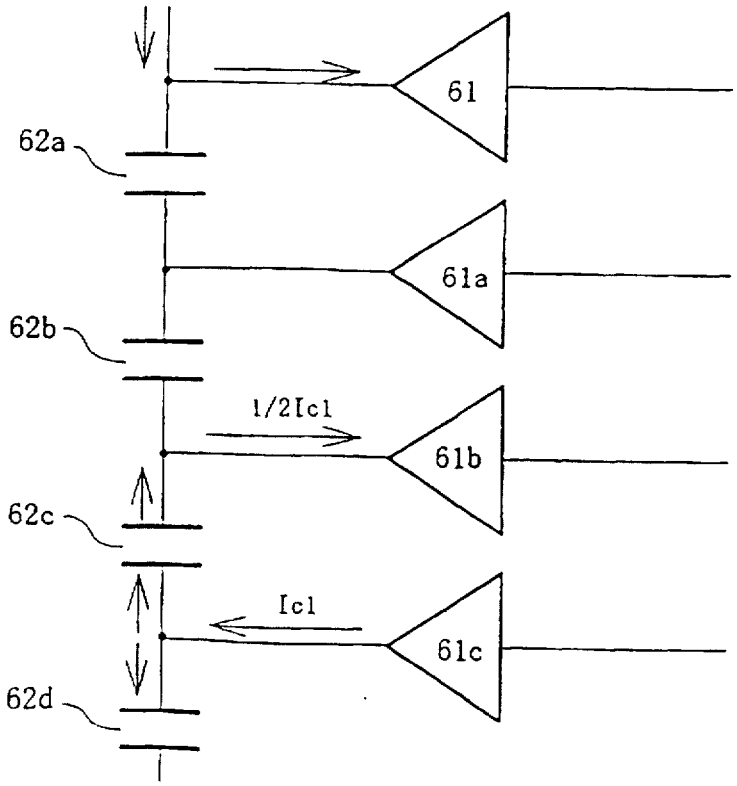

In FIG. 4, when an odd-group Enable is set to "1" and an ink jetting timing 1 is set to "1," AND gates 63*a* and 63*e* are opened so that the parallel data are input to drivers 61*a* and 61*e* and "0" data are input to the other drivers. Likewise, the parallel data are input to a driver 61*c* when the odd group Enable is set to "1" and an ink jetting timing 2 is set to "1" and to drivers 61*b* and 61*f* when an even group Enable is set to "1" and the ink jetting timing 1 is set to "1" and to a driver 61*d* when the even group Enable is set to "1" and the ink jetting timing 2 is set to "1." Thus, a skilled artisan would appreciate that ink jetting timing 1 and ink jetting timing 2 oscillate between "0" and "1" to jet ink from like groups of channels. FIGS. 3A and 3B are equivalent circuit diagrams showing the connection arrangement of the ink jetting device and the controller.

First, the odd group Enable and the ink jetting timing 1 are set to "1", and the even group Enable and the ink jetting timing 2 are set to "0," and the drivers output the driving voltage waveform shown in FIG. 1A. In the ink channel 4A to which the pulse Va is applied, both of the side walls thereof are deformed as shown in FIG. 2B. At this time, even when the ink jetting is carried out, the ink channel 4C is still supplied with the voltage of zero because the ink jetting timing 2 is set to "0" and an AND gate 63*c* is closed although the ink channel 4C belongs to the same group as the ink channel 4A. Further, the same driving voltages as applied to the ink channels 4A and 4C are alternately applied to the other ink channels of the odd group. No voltage pulse is applied to those ink channels that perform no ink jetting operation.

At this time, as shown in the equivalent circuit of FIG. 3A, the driver 61*a* that applies the voltage supplies the current Ia1 to the capacitors 62*a* and 62*b* half by half to charge the capacitors 62*a* and 62*b*. However, the driver 61*c* supplies no current. On the other hand, the current ½Ia1 flows into the driver 61*b* from the capacitor 62*b*.

When the ink jetting timing 2 is set to "1" and the voltage pulse Vc rises up after the time L(2*a*) shown in FIG. 1C, the side walls 6C and 6D are deformed as shown in FIG. 2C. At this time, the driver 61*c*, which applies the voltage, supplies the current Ic1 to the capacitors 62*c* and 62*d* half by half to charge these capacitors. However, the driver 61*a* has finished its charging operation for the capacitors 62*a* and 62*b*, and thus, it supplies no current. Further, the current ½Ic1 flows into the driver 61*b* from the capacitor 62*c*.

When the time of L/a elapses from the rise-up of each voltage pulse Va, Vc, the pressure in each ink channel 4 is inverted according to the pressure wave propagation theory, and, for example, the pressure in the ink channel 4A is inverted to a positive pressure. If the application of the voltage pulse Va is stopped by setting the ink jetting timing 1 or 2 to "0" in synchronism with the above pressure-inversion timing, the side walls 6A and 6B are returned to their initial states as before deformation. At this time, high pressure occurs in the ink channel 4A, and an ink droplet is jetted from the nozzle intercommunicating with the ink channel 4A.

On the other hand, the current pulse waveforms of the drivers 61*a* and 61*c* occur dispersedly (with a time lag) on the time axis; that is, the occurrence timings of these current pulse waveforms are different from each other as shown in FIGS. 1A to 1D, so that the current peak value occurring on the power source line 54 and the ground line 55 of the LSI chip 51 can be reduced to a half of that of the prior art.

The same operation can be performed for the ink channels 4B and 4D belonging to the even group with the driving waveforms of FIGS. 1B and 1D.

If a time lag is set between the ink jetting timings of the ink channels in the same group, dots would be slightly displaced on a print medium. However, the value of L/a in FIGS. 1A to 1D is usually set to several microseconds to several tens of microseconds, and thus, the displacement of the dots is such a small amount that it cannot be visually identified by eyes, so that it is negligible. Further, when the value of L/a is large or the displacement of dots in a high-speed printing operation is remarkable, the respective nozzles 12 may be arranged while displaced relatively to suppress the displacement of the dots.

Figure 5:
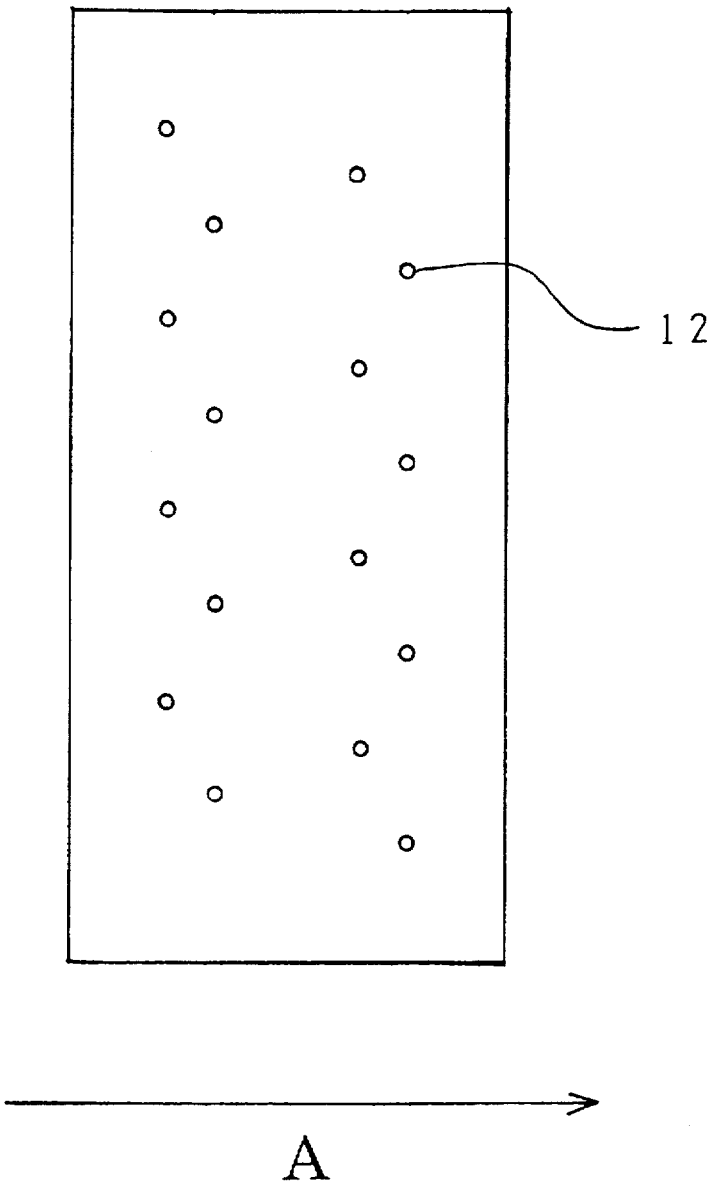
FIG. 5 illustrates a nozzle plate that suppresses the time lag of the ink jetting timings of the ink channels.
Figures 6A, 6B, 6C, 6D:
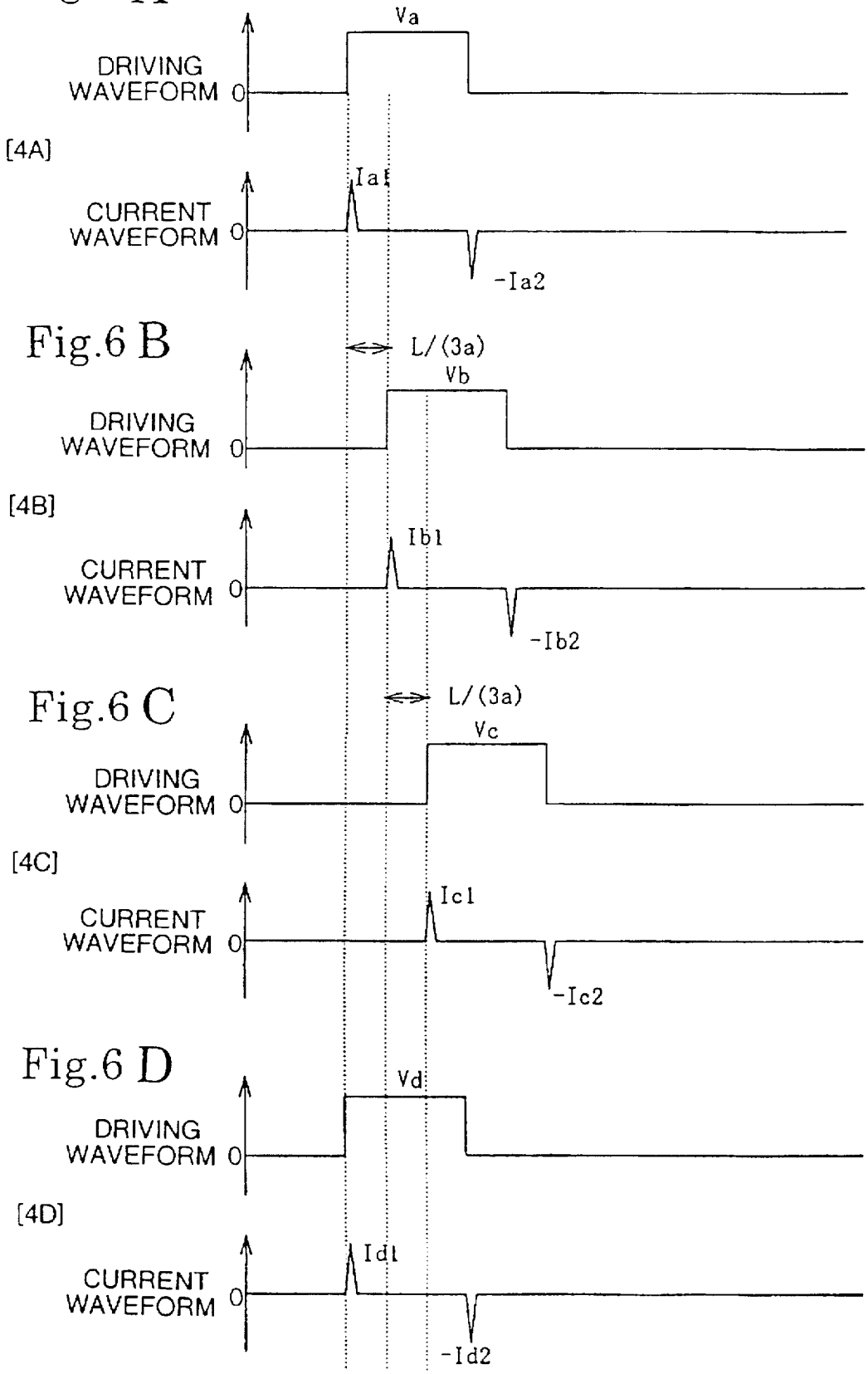
FIGS. 6A to 6D are timing charts showing a driving method of another embodiment of the present invention.

With respect to the ink jetting device shown in FIG. 5, an ink droplet is jetted alternately from the ink channels 4 of the odd and even groups while the ink jetting device is moved in a direction as indicated by an arrow A, thereby performing the print operation. Therefore, the nozzles 12 are positioned while being alternately displaced (in a wobbling arrangement) as shown in FIG. 5 to suppress the time lag of the ink jetting timings of the ink channels.

Another embodiment of the present invention will be described with reference to FIGS. 6A to 6D, 7 and 8. The ink jetting device of this embodiment is designed so that the motion of each ink channel does not affect the other ink channels. For example, in this embodiment, every other of the ink channels is used as an air channel (dummy channel) in which no ink is filled. The dummy channels jet no ink droplet therefrom, and these dummy channels serve to prevent an erroneous ink jetting operation wherein the ink droplet is jetted from an ink channel although the ink channel is not currently required to jet the ink droplet.

Figure 7:
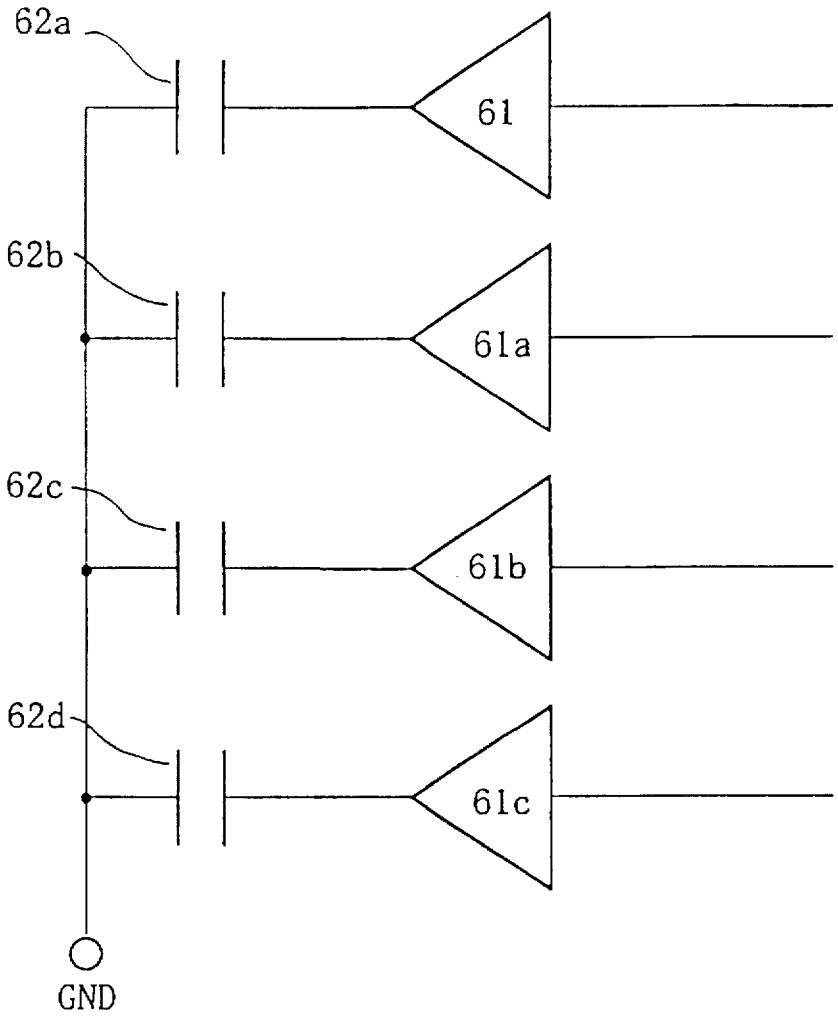
FIG. 7 is an equivalent circuit diagram showing a connection arrangement of an ink jetting device and a controller of another embodiment of the present invention.

FIG. 7 is an equivalent circuit diagram showing the connection arrangement of the ink jetting device of this embodiment with the LSI chip 51. The electrodes formed in the dummy channels are grounded. The driving voltage pulse waveforms and the current pulse waveforms for this case are shown in FIGS. 6A to 6D. In this case, the ink channels 4A, 4D, . . . are grouped as a first group, the ink channels 4B, 4E, . . . are grouped as a second group, and the ink channels 4C, 4F, . . . are grouped as a third group.

Figure 8:
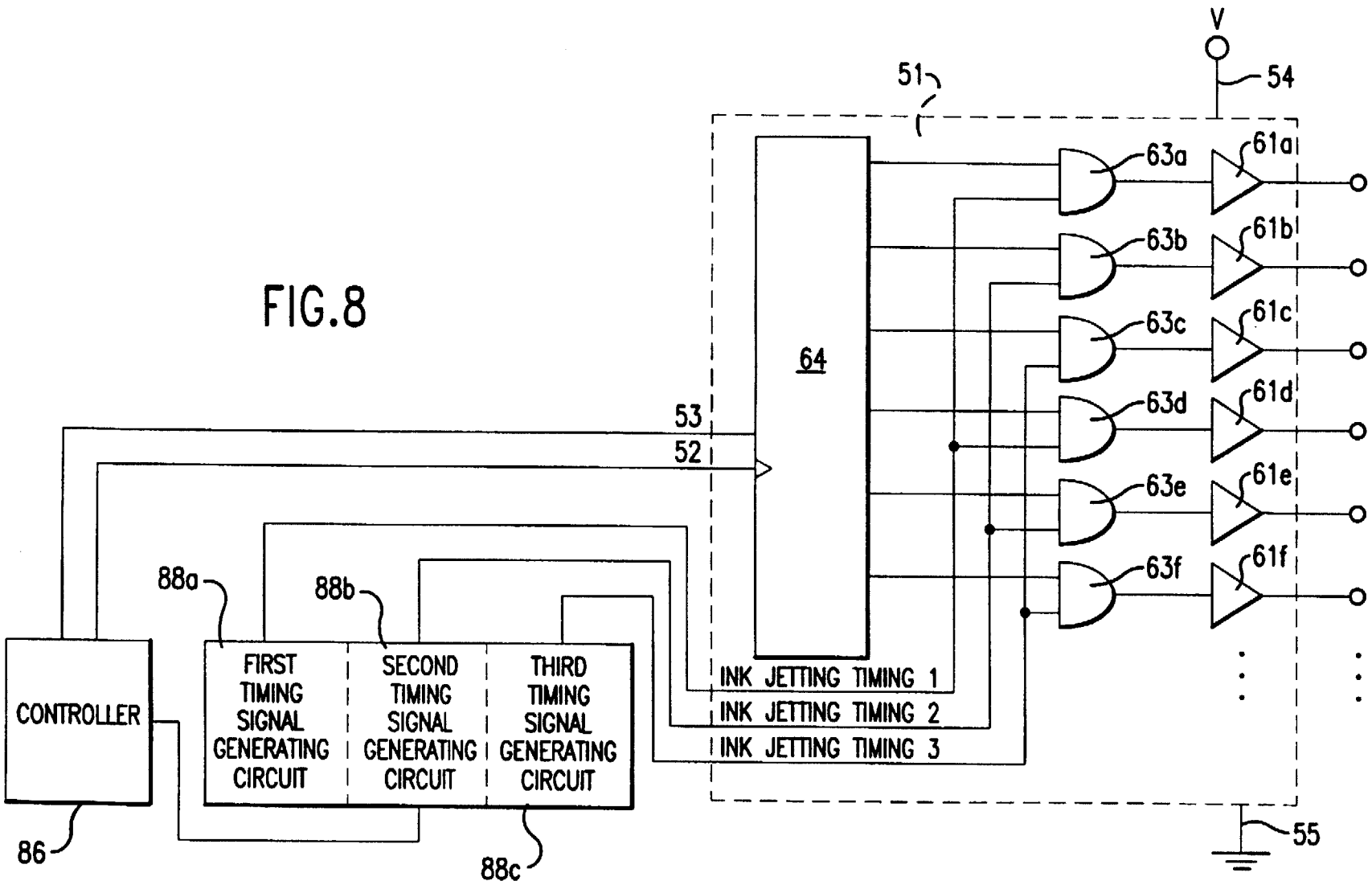
FIG. 8 is a diagram showing an internal construction of a controller of another embodiment of the present invention.
Figure 9:
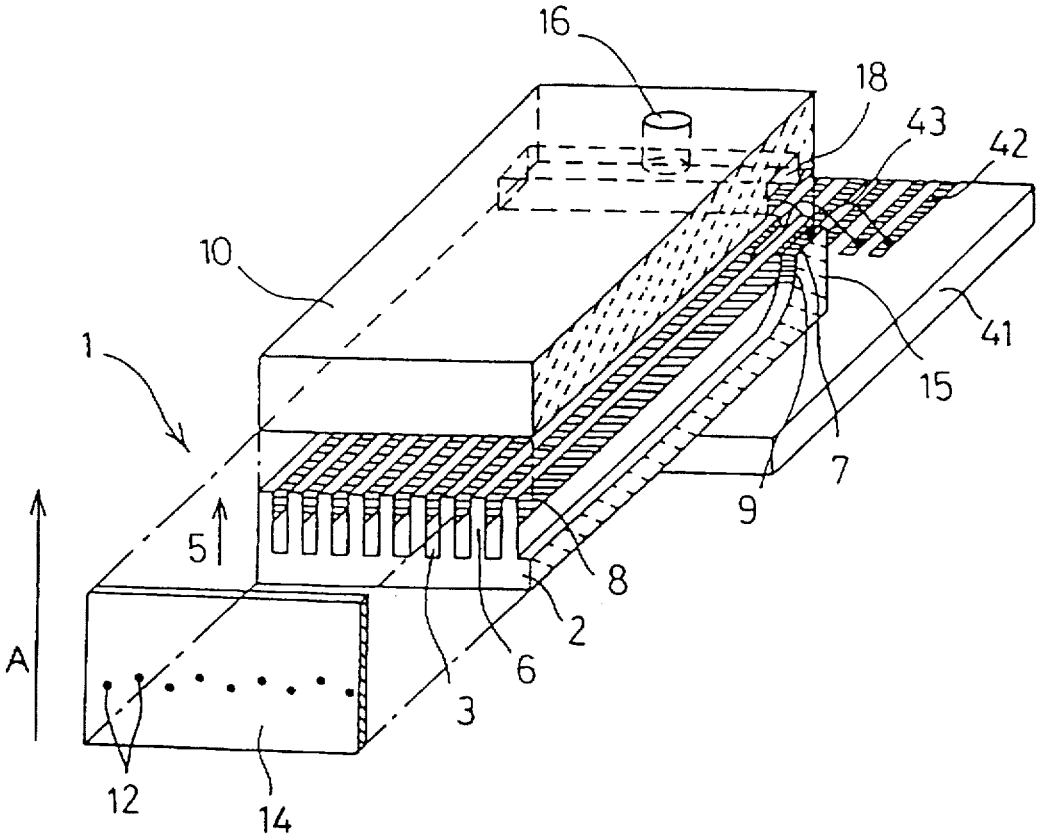
Fig.9 PRIOR ART
FIG. 9 is a perspective view showing a conventional shear mode type ink jetting device.
Figure 10:
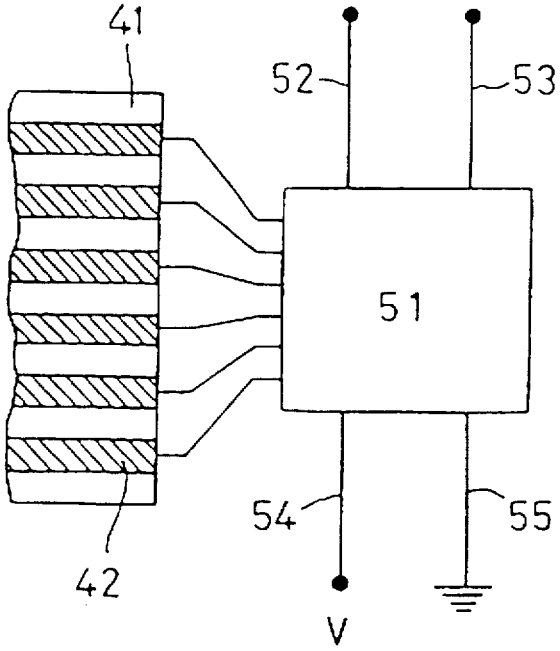
Fig.10 PRIOR ART
FIG. 10 is a diagram showing a conventional controller.
Figure 11:
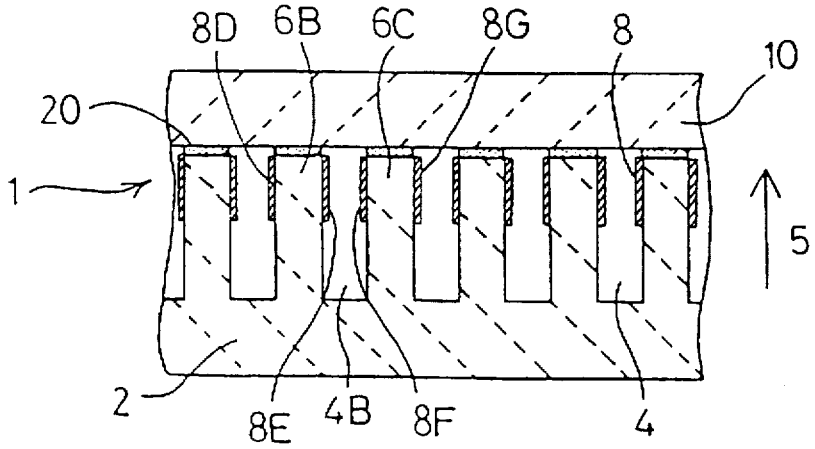
Fig.11 PRIOR ART
FIG. 11 is a cross-sectional view showing a conventional shear mode type ink jetting device.
Figure 12:
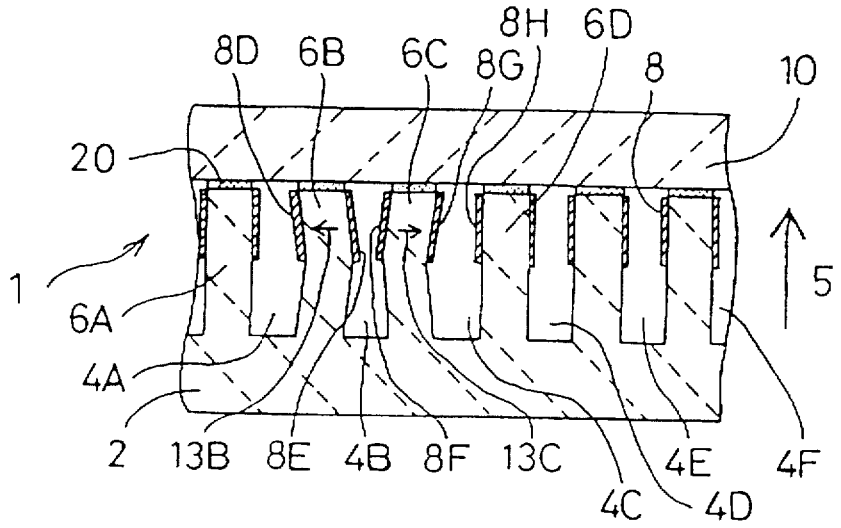
Fig.12 PRIOR ART
FIG. 12 is a diagram showing an operation of the conventional shear mode type ink jetting device.
Figure 13A:
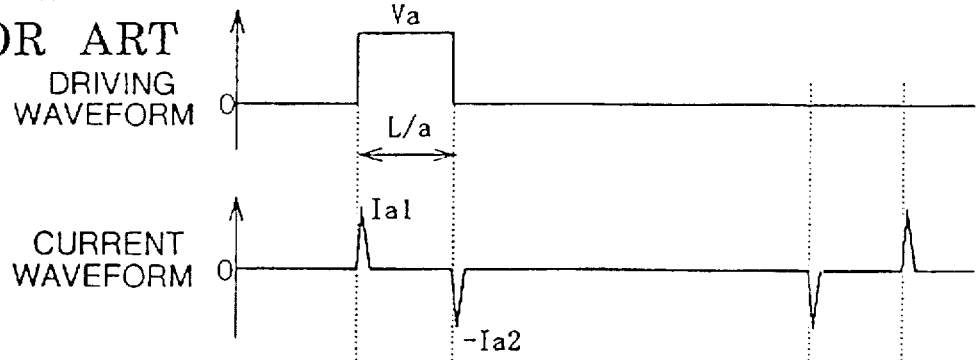
Fig.13 A PRIOR ART
FIGS. 13A to 13D are timing charts showing a conventional driving method.
Figure 13B:
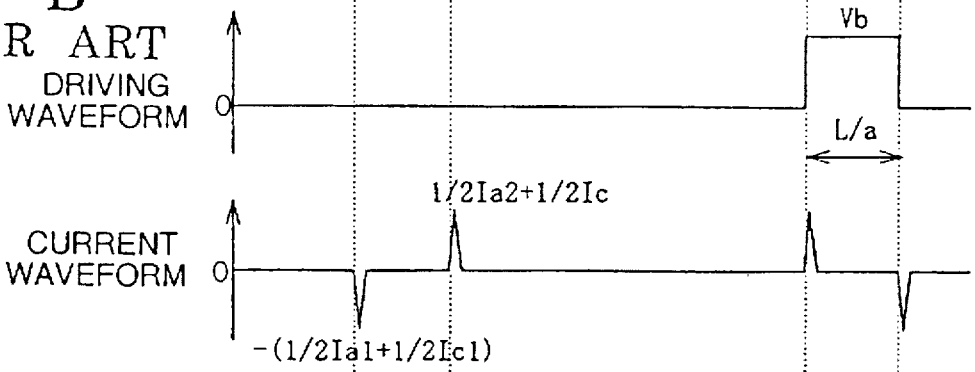
Fig.13 B PRIOR ART
Figure 13C:
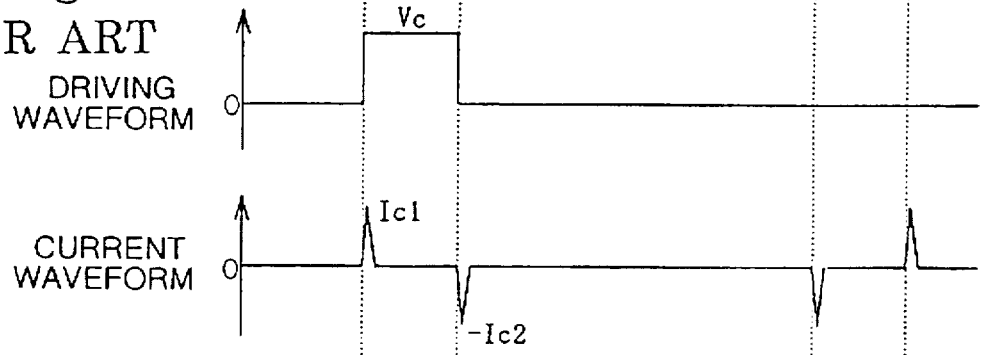
Fig.13 C PRIOR ART
Figure 13D:
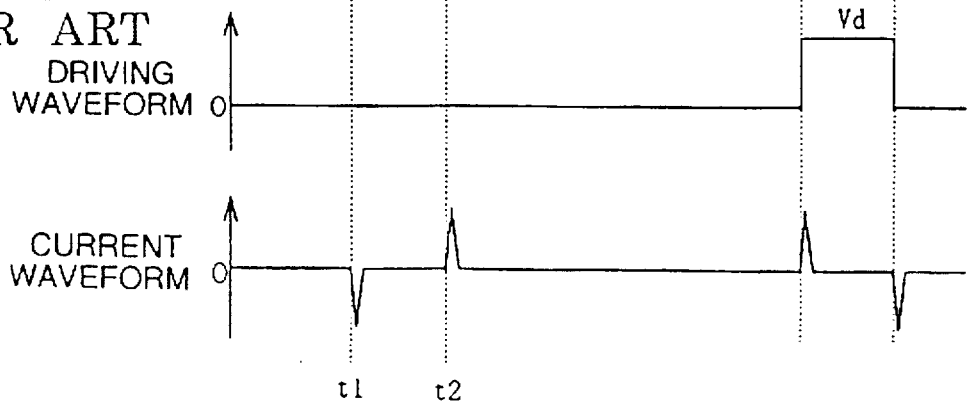
Fig.13 D PRIOR ART
Figure 14A:
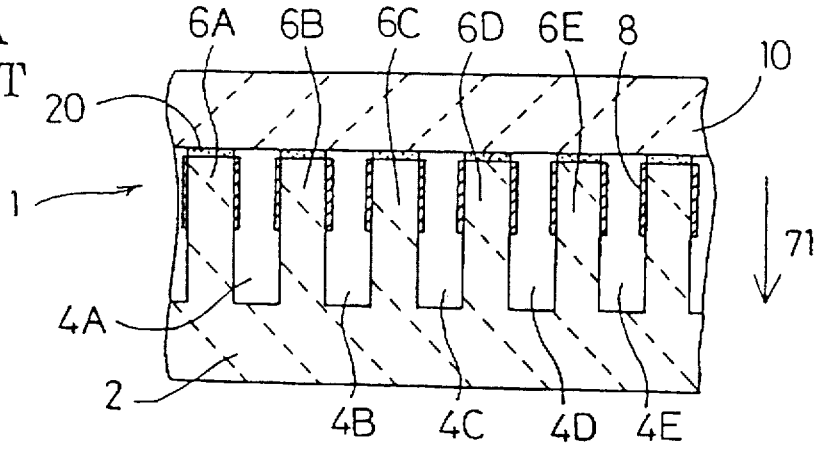
Fig.14 A PRIOR ART
FIGS. 14A to 14C are cross-sectional views of an ink jetting device illustrating an operation of the prior art.
Figure 14B:
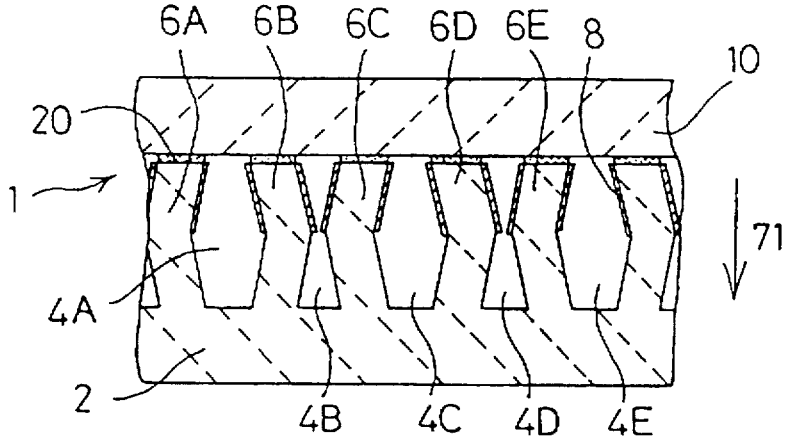
Fig.14 B PRIOR ART
Figure 14C:
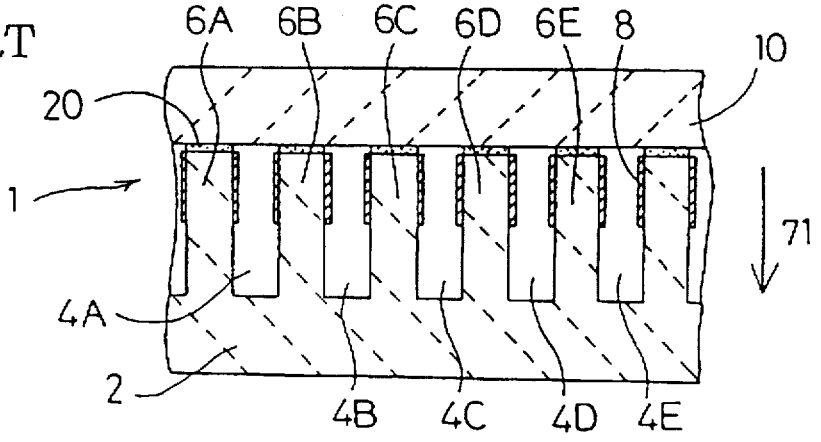
Fig.14 C PRIOR ART
Figure 15A:
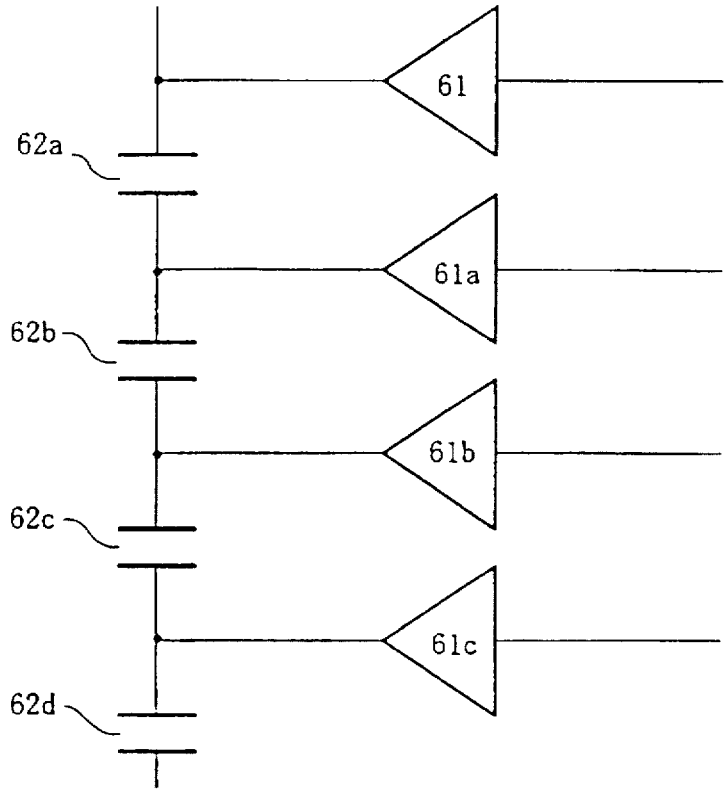
Fig.15 A PRIOR ART
FIGS. 15A and 15B are equivalent circuit diagrams showing a connection arrangement of an ink jetting device and a controller of the prior art.
Figure 15B:
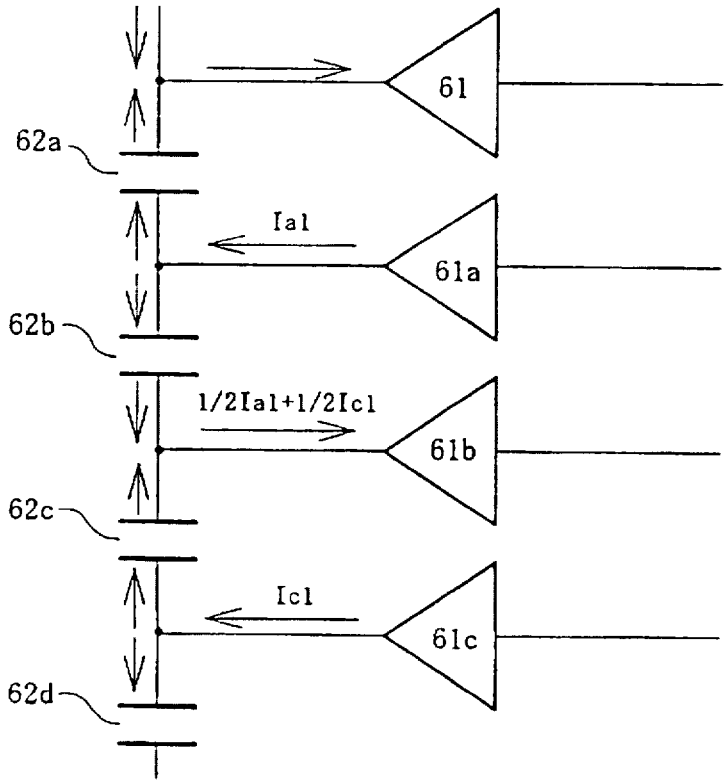
Fig.15 B PRIOR ART

FIG. 8 is a diagram showing the internal construction of the LSI chip 51 operably coupled to the controller 86, a first timing generating circuit 88*a*, a second timing generating circuit 88*b* and a third timing generating circuit 88*c*. The controller 86 is operably coupled to each of the first, second and third timing generating circuits 88*a*, 88*b* and 88*c* respectively. On the basis of the serial clock pulses supplied from the clock line 52, the LSI chip 51 latches into the SP converter 64 data that are transmitted as serial data and appear on the data line 53, thereby converting the data to parallel data.

When the ink jetting timing 1 is set to "1," the AND gates 63*a* and 63*d* are opened, and the parallel data are input to the drivers 61*a* and 61*d* while "0" is input to the other drivers. Likewise, the parallel data are input to the drivers 61*b* and 61*e* when the ink jetting timing 2 is set to "1," and input to the drivers 61*c* and 61*f* when the ink jetting timing 3 is set to "1." The voltage driving waveform of each group is formed as shown in FIGS. 6A to 6D by setting a timing at which the ink jetting timing 1, 2, 3 is set to "1" at a time-lag interval of L/(3*a*). Accordingly, the current pulse waveforms of the drivers 61*a*, 61*b* and 61*c* are not coincident with one another on the time axis, and thus, the three current peaks occur dispersedly. Therefore, the value of the current peak occurring on the power source line and the earth line of the LSI chip 51 can be reduced to a half of that of the prior art.

In the above embodiment, the ink channels are grouped into two or three groups. However, the same driving method can be applied when the ink channels are grouped into four or more groups. Further, in the above embodiment, a single rectangular waveform is used as a driving waveform. However, another driving waveform such as a composite waveform of rectangular waveforms may be used in this invention. Still further, this invention is not limited to the above embodiments, and any modification may be made without departing from the subject matter of this invention.

What is claimed is:

1. An ink jetting device having at least two groups of channels with each of the groups of channels including a plurality of channels, each of the channels having a volume that is variable in accordance with deformation of piezoelectric elements, the ink jetting device comprising:

a controller for generating data signals corresponding to each of the channels, the data signals indicating whether ink jetting is performed;

a timing generating circuit for generating at least two timing signals for each of the at least two groups of channels and electrically connected to said controller, said timing generating circuit oscillating the at least two timing signals for ink jetting from each of the at least two groups of channels with a time lag for a time lag period that is shorter than a period when a voltage is applied to the piezoelectric elements; and a plurality of driving circuits corresponding to each of the channels in each of the at least two groups of channels and electrically connected to said timing generating circuit and said controller, said driving circuits applying the voltage to the piezoelectric elements based on the data signals generated by said controller and a respective one of the timing signals generated by said timing generating circuit.

2. The ink jetting device as claimed in claim 1, further comprising a plurality of latching circuits, each of the latch circuits corresponding to each one of said channels and electrically connected to said controller and said timing generating circuit, said latching circuits latching the data signals generated by said controller, wherein said plurality of driving circuits apply the voltage to the piezoelectric elements based on the latched signals when receiving a respective one of the timing signals from said timing generating circuit.

3. The ink jetting device as claimed in claim 2, wherein at least parts of said plurality of channels are insulated from one another by partition walls formed of piezoelectric materials.

4. The ink jetting device as claimed in claim 1, further comprising a nozzle plate connected to said ink jetting device adjacent said channels, said nozzle plate including a plurality of nozzles through which ink is jetted, wherein said nozzles are alternately displaced so as to suppress the time lag between the at least two timing signals.

5. The ink jetting device as claimed in claim 1, wherein said controller is operative to prevent adjacent channels from simultaneously jetting ink.

6. The ink jetting device as claimed in claim 1, wherein every other of the channels is an air channel in which no ink is contained and remaining ones of the channels are ink channels in which ink is contained.

7. The ink jetting device as claimed in claim 6, further comprising electrodes disposed in said air channels, wherein said electrodes are grounded.

8. The ink jetting device as claimed in claim 1, wherein an electrode is associated with each of said piezoelectric elements such that a pair of electrodes are disposed in each of said channels, wherein respective ones of each pair of electrodes are electrically connected to one another.

9. The ink jetting device as claimed in claim 1 further comprising a plurality of electrodes, wherein each of said plurality of electrodes is associated with a corresponding one of said piezoelectric elements, each electrode being affixed to a portion of a respective one of said channels.

10. An ink jetting device as claimed in claim 1, wherein select ones of the plurality of driving circuits correspond to a first group of channels and remaining ones of the plurality of driving circuits correspond to a second group of channels that are different from the first group of channels whereby each channel of the first group of channels is disposed between consecutive ones of channels of the second group of channels.

11. An ink jetting device as claimed in claim 1, wherein the plurality of channels are ink channels containing ink.

12. The ink jetting device as claimed in claim 1, wherein the plurality of channels of each of the at least two groups of channels are disposed relative to each other in a non-adjacent relationship.

13. An ink jetting device having at least two groups of channels with each of the groups of channels including a plurality of channels, each of the channels having a volume that is variable in accordance with deformation of piezoelectric elements, the ink jetting device comprising:

control means for generating a data signal indicating whether ink jetting is to be performed;

timing generating means for generating at least two timing signals for each of the at least two groups of channels and for oscillating the timing signals for ink jetting from each of the at least two groups of channels with a time lag for a time lag period that is shorter than a period when a voltage is applied to the piezoelectric elements said timing generating means being electrically connected to said control means; and driving means for applying the voltage to the piezoelectric elements based on the data signal generated by said control means and a respective one of the timing signals generated by said timing generating means, said driving means being electrically connected to said timing generating means and said control means.

14. The ink jetting device as claimed in claim 13, further comprising latching means for latching the data signal generated by said control means, wherein said driving means apply the voltage to the piezoelectric elements based on the latched signal when receiving a respective one of the timing signals from said timing generating means, said latching means being electrically connected to said control means, said driving means and said timing generating means.

15. The ink jetting device as claimed in claim 14, further comprising insulating means for insulating at least parts of said plurality of channels from one another.

16. The ink jetting device as claimed in claim 13, further comprising means for suppressing the time lag between the at least two timing signals.

17. The ink jetting device as claimed in claim 13, wherein every other of the channels is an air channel in which no ink is contained and remaining ones of the channels are ink channels in which ink is contained.

18. The ink jetting device as claimed in claim 13, further comprising a plurality of electrodes, wherein each of said electrodes is associated with a corresponding one of said piezoelectric elements such that a pair of electrodes are disposed in each of said channels, wherein respective ones of each pair of electrodes are electrically connected to one another.

19. An ink jetting device as claimed in claim 13, wherein said driving means correspond to a first group of channels and a second group of channels that are different from the first group of channels whereby each one of the first group of channels is disposed between consecutive ones of the second group of channels.

20. An ink jetting device as claimed in claim 13, wherein the plurality of channels are ink channels containing ink.

21. The ink jetting device as claimed in claim 13, wherein the plurality of channels of each of the at least two groups of channels are disposed relative to each other in a non-adjacent relationship.

22. An ink jetting device having a first group of ink channels and a second group of ink channels for jetting ink, each ink channel having a volume that is variable in accordance with deformation of piezoelectric elements, the ink jetting device comprising:

a controller for generating a data signal corresponding to each of the ink channels, the data signal indicating whether ink jetting is performed;

a first timing generating circuit for generating a first timing signal and electrically connected to said controller;

a second timing generating circuit for generating a second timing signal and electrically connected to said controller, the second timing signal oscillating with a time lag from the first timing signal, the time lag being for a time lag period that is shorter than a period when a voltage is applied to the piezoelectric elements;

a first plurality of driving circuits corresponding to the first group of ink channels, respectively, and electrically connected to said controller and said first timing generating circuit, each of said first driving circuits applying the voltage to the piezoelectric elements based on the data signal generated by said controller and the first timing signal generated by said first timing generating circuit; and a second plurality of driving circuits corresponding to the second group of ink channels, respectively, and electrically connected to said controller and said second timing generating circuit, each of said second driving circuits applying the voltage to the piezoelectric elements based on the data signal applied by said controller and the second timing signal generated by said second timing generating circuit.

23. The ink jetting device as claimed in claim 22, further comprising a latching circuit corresponding to each of the ink channels and electrically connected to said controller, said first and second driving circuits and said first and second timing generating circuits, said latching circuit latching the data signal generated by said controller, wherein said first and second pluralities of driving circuits apply the voltage to the piezoelectric elements based on the latched signal when receiving a respective one of the first and second timing signals from said first and second timing generating circuits, respectively.

* * * * *